US010827835B2

(12) United States Patent
Kim et al.

(10) Patent No.: US 10,827,835 B2
(45) Date of Patent: Nov. 10, 2020

(54) SLIDE RAIL LOCKING DEVICE

(71) Applicant: SEGOS CO., LTD., Incheon (KR)

(72) Inventors: Duc Hoi Kim, Incheon (KR); Byeong Cheon Jang, Incheon (KR)

(73) Assignee: SEGOS CO., LTD., Incheon (KR)

( * ) Notice: Subject to any disclaimer, the term of this patent is extended or adjusted under 35 U.S.C. 154(b) by 0 days.

(21) Appl. No.: 16/063,915

(22) PCT Filed: Dec. 19, 2016

(86) PCT No.: PCT/KR2016/014857
§ 371 (c)(1),
(2) Date: Jun. 19, 2018

(87) PCT Pub. No.: WO2017/119632
PCT Pub. Date: Jul. 13, 2017

(65) Prior Publication Data

US 2019/0000230 A1 Jan. 3, 2019

(30) Foreign Application Priority Data

Jan. 5, 2016 (KR) ..... 10-2016-0000746
Sep. 13, 2016 (KR) ..... 10-2016-0117859

(51) Int. Cl.
*A47B 88/43* (2017.01)
*A47L 15/50* (2006.01)
(Continued)

(52) U.S. Cl.
CPC ..... *A47B 88/43* (2017.01); *A47B 88/427* (2017.01); *A47B 88/50* (2017.01); *A47L 15/50* (2013.01);
(Continued)

(58) Field of Classification Search
CPC ... A47B 88/423; A47B 88/0418; A47B 88/43; A47B 88/044; F24C 15/16; F24C 15/168; A47L 15/50
See application file for complete search history.

(56) References Cited

U.S. PATENT DOCUMENTS 3,740,109 A * 6/1973 Pfaffendorf ..... A47B 43/02 312/257.1
3,771,849 A * 11/1973 Barber ..... A47B 88/43 312/350
(Continued)

FOREIGN PATENT DOCUMENTS

CN 101384856 A 3/2009
CN 102762128 A 10/2012
(Continued)

OTHER PUBLICATIONS

Translation KR20110090728A, 18 pages (Year: 2011).*
(Continued)

*Primary Examiner* — Andrew M Roersma
(74) *Attorney, Agent, or Firm* — The PL Law Group, PLLC

(57) ABSTRACT

A slide rail locking device includes an upper locking plate coupling a supporting bar mounted on an inside wall of a main body and a slide rail fixed to a side or bottom surface of a drawer, located above the supporting bar, and locked into the slide rail, a lower locking plate located below the supporting bar, a connection plate connecting the upper locking plate and the lower locking plate, and an extended plate formed by being bulged down from the lower locking plate to face the upper locking plate. A gap is formed between the slide rail locking device and a vertical supporting bar, whereby undesired movement of the slide rail locking device generated by a drawing motion of the drawer
(Continued)

being drawn out of and retracted into the main body may be offset.

5 Claims, 4 Drawing Sheets

(51) Int. Cl.

| | |
|---|---|
| ***F24C 15/16*** | (2006.01) |
| ***A47B 88/50*** | (2017.01) |
| ***F25D 25/02*** | (2006.01) |
| ***A47B 88/42*** | (2017.01) |
| ***F25D 23/06*** | (2006.01) |
| ***A47B 88/427*** | (2017.01) |

(52) U.S. Cl.
CPC ..... *F24C 15/16* (2013.01); *F25D 25/02* (2013.01); *A47B 2210/17* (2013.01); *F24C 15/168* (2013.01); *F25D 23/067* (2013.01); *F25D 25/024* (2013.01)

(56) References Cited

U.S. PATENT DOCUMENTS

| | | | | |
|---|---|---|---|---|
| 3,806,994 | A * | 4/1974 | Lankford | E04C 5/167 403/397 |
| 5,904,412 | A * | 5/1999 | Lammens | A47B 88/43 312/334.1 |
| 6,643,900 | B2 * | 11/2003 | Jahrling | A47B 55/02 24/336 |
| 8,162,560 | B2 * | 4/2012 | Wittgrebe | F24C 15/16 126/339 |
| 8,573,720 | B2 * | 11/2013 | Wittgrebe | A47L 15/504 126/339 |
| 8,820,689 | B2 * | 9/2014 | Reidt | F24C 15/168 24/563 |
| 9,078,517 | B2 * | 7/2015 | Rehage | F24C 15/168 |
| 2005/0217501 | A1 | 10/2005 | Babucke et al. | |
| 2011/0113597 | A1 * | 5/2011 | Budde | F24C 15/168 24/457 |
| 2011/0123260 | A1 * | 5/2011 | Budde | F24C 15/168 403/188 |
| 2012/0248955 | A1 * | 10/2012 | Rehage | F24C 15/168 312/334.1 |
| 2012/0305718 | A1 * | 12/2012 | Park | F24C 15/16 248/201 |
| 2014/0334751 | A1 * | 11/2014 | Meyer | F24C 15/168 384/22 |

FOREIGN PATENT DOCUMENTS

| | | | | |
|---|---|---|---|---|
| DE | 102009034967 | A1 * | 2/2011 | F24C 15/168 |
| EP | 1158185 | A2 | 11/2001 | |
| EP | 2325565 | A2 | 5/2011 | |
| EP | 2532273 | A1 | 12/2012 | |
| EP | 2532274 | A2 | 12/2012 | |
| KR | 20-0333789 | Y1 | 11/2003 | |
| KR | 10-2005-0043117 | A | 5/2005 | |
| KR | 10-2005-0107519 | A | 11/2005 | |
| KR | 10-2007-0042059 | A | 4/2007 | |
| KR | 10-2007-0072908 | A | 7/2007 | |
| KR | 10-2008-0050648 | A | 6/2008 | |
| KR | 10-2011-0090728 | A | 8/2011 | |
| KR | 10-2015-0134189 | A | 12/2015 | |
| WO | 2007/074114 | A1 | 7/2007 | |
| WO | WO-2013087375 | A1 * | 6/2013 | F24C 15/16 |

OTHER PUBLICATIONS

International Search Report for PCT/KR2016/014857 dated Mar. 29, 2017.

Office action dated Apr. 22, 2019 from China Patent Office in a counterpart China Patent Application No. 201680077488.5 (all the cited references are listed in this IDS.) (English translation is also submitted herewith.).

European Search Report for EP16884015.5 dated Jul. 26, 2019 from European patent office in a counterpart European patent application.

Communication pursuant to Article 94(3) EPC for EP16884015.5 dated Aug. 3, 2020 from European patent office in a counterpart European patent application.

* cited by examiner

SLIDE RAIL LOCKING DEVICE

CROSS REFERENCE TO RELATED APPLICATIONS AND CLAIM OF PRIORITY

This application claims benefit under 35 U.S.C. 119(e), 120, 121, or 365(c), and is a National Stage entry from International Application No. PCT/KR2016/014857, filed Dec. 19, 2016, which claims priority to the benefit of Korean Patent Application Nos. 10-2016-0000746 filed on Jan. 5, 2016 and 10-2016-0117859 filed on Sep. 13, 2016 in the Korean Intellectual Property Office, the entire contents of which are incorporated herein by reference.

TECHNICAL FIELD

The present invention relates generally to a slide rail locking device and, more particularly, to a slide rail locking device reducing transferring of a movement of the slide rail locking device caused by a drawing motion of a drawer to a vertical supporting bar by forming a gap between the slide rail locking device and the vertical supporting bar.

BACKGROUND ART

Generally, a drawer is slidably installed in an electronic product such as a refrigerator, a dishwasher, and so on; cooking appliances such as an oven and so on; and a main body of furniture receiving and storing a variety of goods to allow a user to gain access to the goods. That is, the drawer is drawn out of the main body in a sliding means to receive goods and is retracted into the main body in the same way after receiving the goods.

A slide rail is mounted to opposite sides of the drawer to move smoothly the drawer when being drawn out of and retracted into the main body. A rolling means in a shape of a ball or rail is installed on the slide rail and allows the drawer to move smoothly when the drawer is drawn out of and retracted into the main body by performing a rolling movement. Accordingly, the drawer becomes smoothly slidable, thus being convenient to use.

Particularly, because the inside of the body is heated up to a temperature food is cooked in the case of cooking appliances such as an oven, the slide rail and locking device by which the slide rail is locked (a slide rail locking device) should be formed of thermal resistant material. Accordingly, there is a need to simplify a structure of the slide rail locking device, because a manufacturing cost increases as the structure becomes complex.

For a conventional main body described as above, supporting bars are each installed on one of the opposite inside walls of the main body, and the slide rails fixed to opposite sides of the drawer are mounted to and locked into the supporting bars by the slide rail locking devices.

The supporting bars are formed in a generally U-shaped cross section, and support opposite sides of the drawer. In addition, each of the supporting bars is provided with bent edges at the opposite ends thereof to be fixed to the inside walls of the main body.

The supporting bars are disposed in a vertical direction with a plurality of members to correspond to the number of the drawers, and the slide rail locking device fixing the slide rail to the supporting bar is installed on the slide rail.

Such a conventional slide rail locking device is installed to the supporting bar in a forcible fitting manner, but being allowed to be attached to and detached from the supporting bar. However, a force generated by the drawer being drawn out of and retracted into the main body along the slide rail is consistently applied on the slide rail locking device, whereby an undesired movement of the slide rail and the drawer is generated as the locking force of the slide rail locking device mounted to the supporting bar is weakened. Accordingly, there have been problems that the locking force of the locking device becomes weak due to a consistent movement thereof, and the slide rail locking device is deformed or detached from the supporting bar particularly due to collision against the vertical support bar.

In addition, there has been a problem that since the conventional slide rail locking device is mounted to the supporting bar in a forcible fitting manner, much force is required when the device is attached, and when an applied force is less than a force required to implement a forcible fitting manner, the slide rail locking device is not coupled to the supporting bar.

In addition, there has been a problem that, when the conventional slide rail locking device is mounted to a position (i.e., a normal position) at which the device is fixed and coupled to the supporting bar in a forcible fitting manner, the slide rail locking device is deformed or damaged.

In addition, in the conventional slide rail locking device, when the drawer moves in a state that a load of the drawer having goods received and a load of the slide rail are concentrated on the slide rail locking device, torsional stress is applied on the locking device fixed to the supporting bar. That is, when a drawer with an increased weight by having goods received is sliding on the slide rail locking device, loads applied on to an inner direction facing each other are transferred, and torsional loads on the supporting bar are generated due to the transfer of the loads at the position the slide rail locking device is fixed. Accordingly, the torsional stress applied when the drawer is moving is applied from opposite sides to a central direction, whereby the torsional stress described as above is concentrated on the conventional slide rail locking device which is inserted in a lateral direction in a forcible fitting manner. Accordingly, there has been a problem that the conventional slide rail locking device is deformed or detached outwards due to a consistently applied stress.

In addition, a force is applied in a lateral direction at the part where the conventional slide rail locking device is fixed to the supporting bar, whereby an undesirable movement of the slide rail locking device becomes significant, and locking force becomes weak. Accordingly, the slide rail locking device is difficult support with one supporting bar, thus needs to be fixed with at least two supporting bars, whereby manufacturing cost and installation cost are increased.

SUMMARY

Accordingly, the present invention has been made keeping in mind the above problems occurring in the prior art, and an object of the present invention is to provide a slide rail locking device capable of enhancing a locking force by being installed to fix each of slide rails mounted to opposite sides of a drawer to an edge part of a supporting bar (that is, a fixing bar).

In order to accomplish the above object, the present invention provides a slide rail locking device coupling a supporting bar 110 mounted on an inside wall of a main body 10 to a slide rail 30 fixed to a side surface or a bottom surface of a drawer 20, wherein the slide rail locking device 100 includes: an upper locking plate 101 located above the supporting bar 110, and locked to the slide rail 30; a lower locking plate 103 located below the supporting bar 110; a connection plate 102 connecting the upper locking plate 101 and the lower locking plate 103 to each other; and an extended plate 104 formed by being bulged down from the lower locking plate 103 to face the upper locking plate 101.

The supporting bar 110 includes: a plurality of horizontal supporting bars 111; and a plurality of vertical supporting bars 112 disposed perpendicular to the plurality of horizontal supporting bars 111, with opposite ends of the plurality of horizontal supporting bars 111 being fixed thereto.

The horizontal supporting bar 111 includes: a plurality of fixing parts 111-1 disposed in parallel with each other and extending toward an inside of the main body 10, with first ends thereof being mounted perpendicular to the vertical supporting bars 112; and supporting parts 111-2 connecting second ends of the plurality of fixing parts 111-1 to each other.

The upper locking plate 101, the lower locking plate 103, and the connection plate 102 are disposed to surround the fixing part 111-1, and the fixing part 111-1 is fixed to at least one of the upper locking plate 101, the lower locking plate 103, and the connection plate 102.

The slide rail locking device further includes: an inclined plate 105 inclined upward toward an associated one of the supporting parts 111-2 from a side portion of the extended plate 104.

A gap 106 is formed to separate the upper locking plate 101, the lower locking plate 103, and the connection plate 102 from the vertical supporting bar 112 by a predetermined distance.

In another embodiment, the present invention provides a slide rail locking device coupling a supporting bar 110 mounted on an inside wall of a main body 10 to a slide rail 30 fixed to a side surface or a bottom surface of a drawer 20, wherein the slide rail locking device 100 includes: a second upper locking plate 101' located above the supporting bar 110, and locked to the slide rail 30; and a second lower locking plate 103' formed by being extended from opposite ends of the second upper locking plate 101', and located below the supporting bar 110.

The supporting bar 110 includes: a plurality of horizontal supporting bars 111; and a plurality of vertical supporting bar 112 disposed perpendicular to the plurality of horizontal supporting bars 111, with opposite ends of the plurality of horizontal supporting bars 111 being fixed thereto, and the horizontal supporting bar 111 includes: a plurality of fixing parts 111-1 disposed in parallel with each other, with first ends thereof being mounted perpendicular to the vertical supporting bars 112; and supporting parts 111-2 connecting second ends of the plurality of fixing parts 111-1 to each other.

The second upper locking plate 101' includes: an upper supporting part 111' in a semicylindrical shape formed at each of opposite ends of the second upper locking plate 101', and brought into contact with an upper part of the supporting part 111-2; and a bent part 112' provided in a direction perpendicular to the supporting part 111-2, and formed to be bent downwards.

The second lower locking plate 103' includes a lower supporting part 113' in a semicylindrical shape formed at each of opposite ends of the second lower locking plate 103', and brought into contact with a lower part of the supporting part 111-2.

The supporting part 111-2 includes a step 111-3 formed along circumference of the supporting part 111-2, with the bent part 112' being seated in the step.

As described above, according to the present invention, while maintaining a locking force, the device has an advantage of being attached and detached more easily compared with a conventional slide rail locking device.

In addition, transferring of a movement of the slide rail locking device caused by a drawing motion of the drawer to a vertical supporting bar can be reduced by forming a gap between the slide rail locking device and the vertical supporting bar Accordingly, the device can prevent the locking force of the locking device from becoming weak due to consistent movement and, particularly, the device can prevent the slide rail locking device from being deformed or detached from the supporting bar due to collision against the vertical support bar.

In addition, the slide rail locking device can be prevented from being deformed or detached from the supporting bar by preventing torsional stress from being concentrated on the slide rail locking device by a motion of the drawer being drawn out of and retracted into a main body.

In addition, an installation cost of slide rail can be reduced since the slide rail can be locked with only one supporting bar by applying the present invention.

DETAILED DESCRIPTION

Terms and words used in present description and claims should not be understood by conventional meaning or meaning defined in dictionaries, and should be understood in accordance with a technical idea of the present disclosure on the basis of a principle that an inventor is entitled to appropriately define a concept of each term in order to describe the present disclosure of himself or herself in a best way. Accordingly, embodiments described in the present description and composition illustrated in drawings are merely most preferable embodiments of the present invention, and do not represent all technical concept of the present invention. Accordingly, it should be understood that various equivalents or modifications are possible. In describing the present invention, detailed descriptions of prior arts and composition which have been deemed to obfuscate the gist of the present invention will be omitted below. Hereinafter, the present disclosure will be described in detail by describing exemplary embodiments of the present disclosure with reference to the accompanying drawings.

Figure 1:
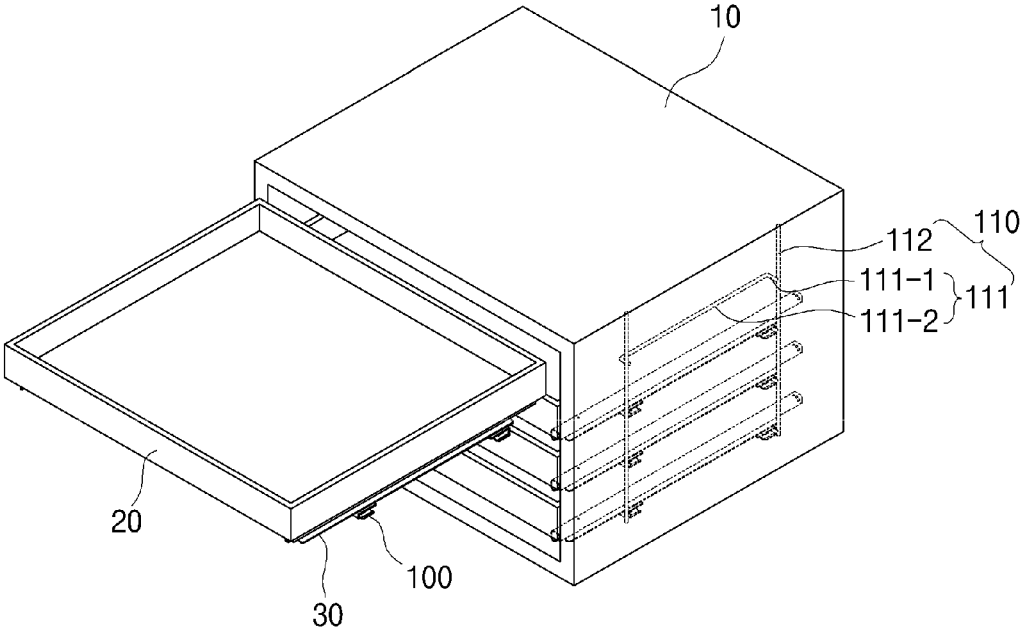
FIG. 1 is a view showing use of a slide rail locking device according to a first embodiment of the present invention.
Figure 2:
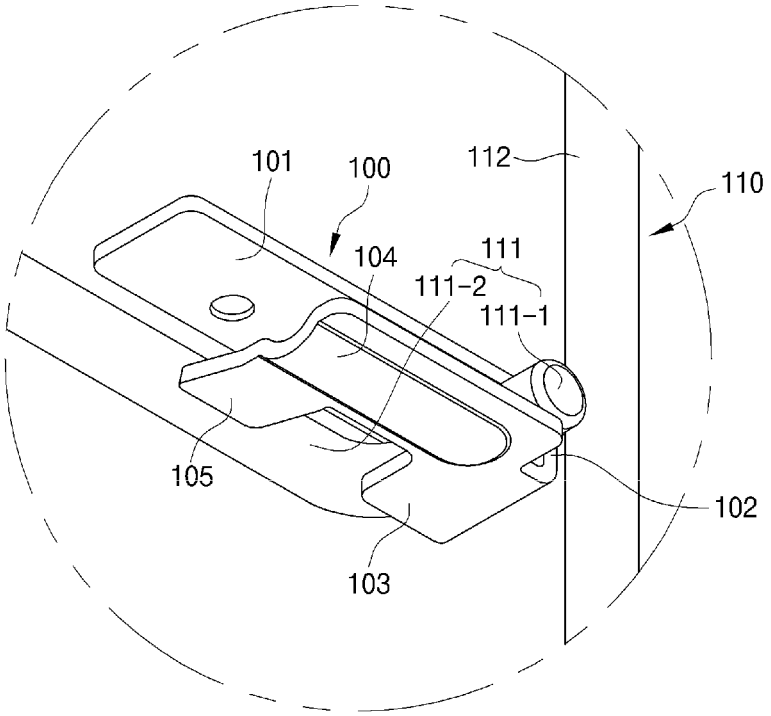
FIG. 2 is a bottom perspective view of the slide rail locking device according to the first embodiment of the present invention.
Figure 3:
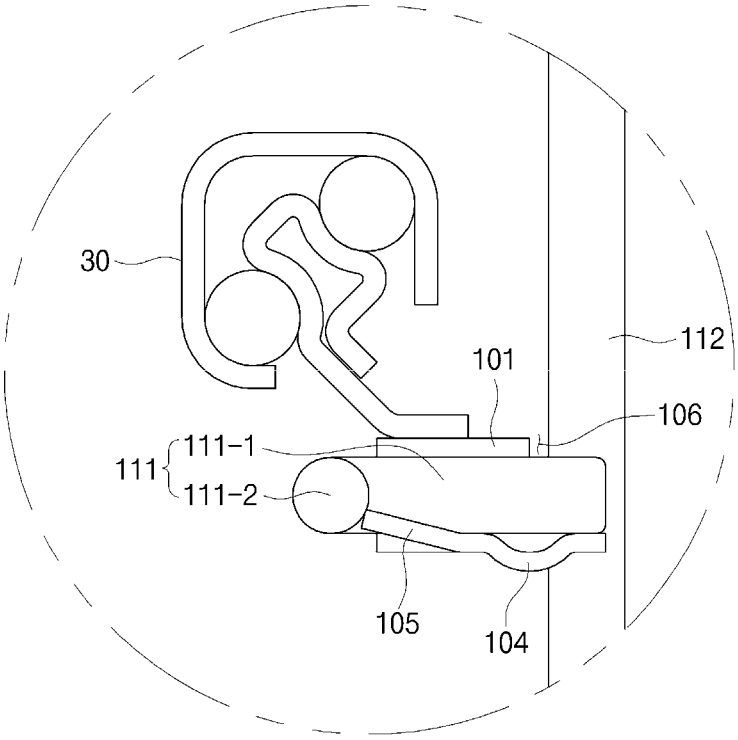
FIG. 3 is a cross-sectional view of the slide rail locking device according to the first embodiment of the present invention.
Figure 4:
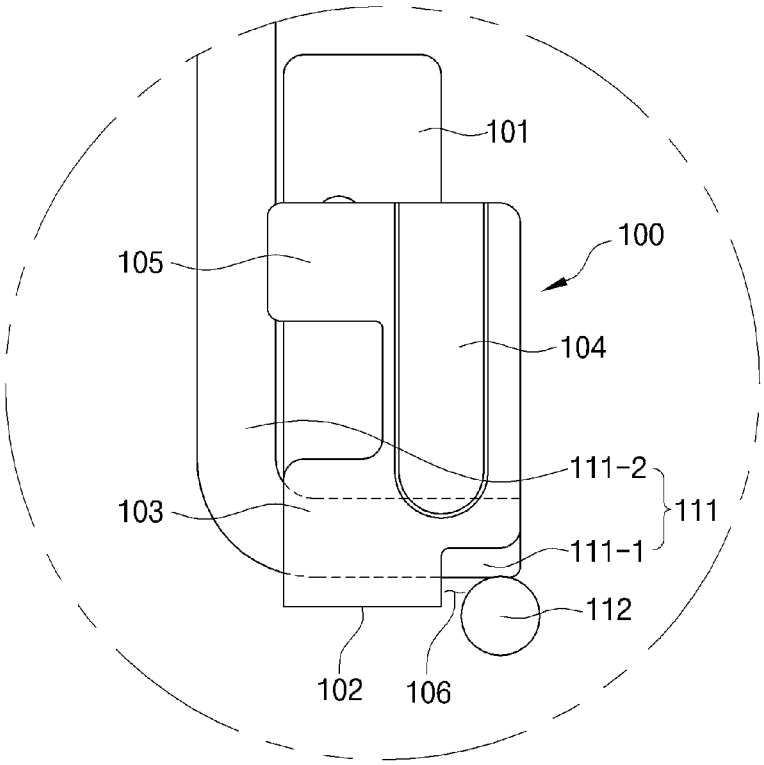
FIG. 4 is a bottom view of the slide rail locking device according to the first embodiment of the present invention.

FIG. 1 is a view showing use of a slide rail locking device according to a first embodiment of the present invention, and FIG. 2 is a bottom perspective view of the slide rail locking device according to the first embodiment of the present invention. In addition, FIG. 3 is the cross-sectional view of a slide rail locking device according to the first embodiment of the resent invention, and FIG. 4 is the bottom view of a slide rail locking device according to the first embodiment of the present invention.

Referring to FIGS. 1 to 4, on an inside wall of a main body 10 of an oven and so on, supporting bars 110 are installed to support a drawer 20. Here, the drawer 20 is a part to store an object by being drawn out of or retracted into the main body 10. In addition, a slide rail locking device according to the present invention plays a role in coupling the supporting bar 110 installed on the inside wall of the main body 10 and a slide rail 30 fixed to a side surface or bottom surface of the drawer 20. Hereinafter, the supporting bar 110 installed on the inside wall of the main body 10 will be described in detail, prior to present a detailed description of the slide rail locking device according to the present invention.

The supporting bar 110 includes a plurality of horizontal supporting bars 111 and a plurality of vertical supporting bars 112. The plurality of horizontal supporting bars 111 is a bar installed horizontally on the inside wall of the main body 10. Number of the horizontal supporting bars 111 should be greater than that of drawers 20 inserted into the body 10. It is because that the slide rail 30 fixed to the drawer 20 is to be mounted to the horizontal supporting bar 111, as will be described later herein.

A plurality of vertical supporting bars 112 is disposed perpendicular to the plurality of horizontal supporting bars 111, wherein opposite ends of the plurality of horizontal supporting bars 111 are fixed to the plurality of vertical supporting bars 112. At this time, the number of the vertical supporting bars 112 needs to be at least two so that the opposite ends of the horizontal supporting bars 111 can be fixed thereto. Accordingly, the intervals between the horizontal support bars 111 are maintained as regular intervals by the vertical support bars 112, and the supporting bar 110 which is an assembly combining the horizontal supporting bars 111 and the vertical supporting bars 112 can be easily installed on the inside wall of the main body 10.

Meanwhile, the horizontal supporting bar 111 includes a plurality of fixing parts 111-1 and supporting parts 111-2. The plurality of fixing parts 111-1 is disposed in parallel with each other toward the inside of the main body 10, with first ends thereof being mounted perpendicular to the vertical supporting bars 112. In addition, the supporting parts 111-2 connect second ends of the plurality of fixing parts 111-1, mounted to the vertical supporting bars 112, to each other. As will be described later herein, the slide rail locking device 100 to which the slide rail 30 is locked into is fixed by being mounted to one of the fixing parts 111-1 or the supporting parts 111-2. Accordingly, being equipped with the slide rail 30, the drawer 20 is installed inside the main body 10, and can be drawn out of or retracted into the main body 10 by the slide rail 30.

Hereinafter, the first embodiment of the slide rail locking device 100 according to the present invention will be described in more detail, referring to FIGS. 1 to 4.

The slide rail locking device 100 includes an upper locking plate 101, a lower locking plate 103, a connection plate 102, an extended plate 104, and an inclined plate 105. The upper locking plate 101 is located above the supporting bar 110 (in more detail, above the fixing part 111-1), and is locked into the slide rail 30. In addition, the upper locking plate 101 is a part to which the slide rail 30 is mounted, and the slide rail 30 fixed to the side surface or the bottom surface of the drawer 20 may be mounted to an upper surface of the upper locking plate 101. In addition, a lower locking plate 103 is located below the supporting bar 110 (in more detail, below the fixing part 111-1), and may be disposed in parallel with the upper locking plate 101.

A connection plate 102 is an element connecting the upper locking plate 101 and the lower locking plate 103. Accordingly, the slide rail locking device 100 is formed to surround the fixing part 111-1 by the upper locking plate 101, the lower locking plate 103, and the connection plate 102. At this time, it is desirable for the connection plate 102 to be disposed at a side of the fixing part 111-1 toward a direction opposite to a direction the supporting part 111-2 is extended from the fixing part 111-1, thereby connecting the upper locking plate 101 and the lower locking plate 103. This is to easily install the slide rail locking device 100 with the slide rail 30 being mounted thereto to the supporting bar 110.

In addition, the slide rail locking device 100 is fixed to the fixing parts 111-1 at one or more places that some of the upper locking plate 101, the lower locking plate 103, and the connection plate 102 are brought into contact with the fixing parts 111-1 by a means such as welding or adhesion.

An extended plate 104 is formed by being bulged down from the lower locking plate 103 to face the upper locking plate 101. That is, the extended plate 104 extends in a direction parallel to the axial direction of the 111-2 extending from the 111-1. In addition, the inclined plate 105 is formed to be inclined upward toward an associated one of the supporting parts 111-2 from a side portion of the extended plate 104. The inclined plate 105 may be formed to have elasticity.

Accordingly, when coupling the device 100 to the supporting bar 110, the slide rail locking device 100 is forced to move from the inside of the main body 10 toward the supporting bar 110 installed on the inside wall of the main body 10. Accordingly, an external force is applied on the slide rail locking device 100 to be brought into contact with the fixing part 111-1, whereby the supporting part 111-2 and the inclined plate 105 are brought into contact with each other. Thereafter, provided the external force is consistently applied, the inclined plate 105 is elastically deformed and spread downwards. Provided the slide rail locking device 100 is brought into contact completely with the fixing part 111-1 passing through the supporting part 111-2, the inclined plate 105 is elastically restored again to be inclined upwards.

After the inclined plate 105 is restored, an end surface of the inclined plate 105 and the supporting part 111-2 are brought into contact with each other. That is, after the slide rail locking device 100 is mounted to the supporting bar 110, the end surface of the inclined plate 105 and the outer circumference surface of the supporting part 111-2 are brought into contact with each other. Accordingly, the slide rail locking device 100 can be easily mounted to the supporting bar 110 by the elastic deformation of the inclined plate 105. In addition, after the slide rail locking device 100 is mounted to the supporting bar 110, the slide rail locking device 100 is difficult to be separated from the supporting bar 110. Accordingly, coupling of the slide rail locking device 100 and the supporting bar 110 is easily and reliably accomplished according to the present invention.

A gap of a preset distance may be formed between the slide rail locking device 100 and the vertical supporting bar 112. That is, being separated from the vertical supporting bar 112 by the preset distance, the upper locking plate 101, the lower locking plate 103, and the connection plate 102 are fixed to the fixing part 111-1. Accordingly, transferring of a movement of the slide rail locking device 100 caused by a drawing motion of the drawer 20 to a vertical supporting bar may be reduced in the present invention. Accordingly, it may prevent locking force of the locking device from becoming weak due to consistent movement and, particularly, it may prevent the slide rail locking device 100 from being deformed, or detached from the supporting bar 110 due to collision against the vertical supporting bar 112.

In addition, the slide rail locking device 100 may be prevented from being deformed or from being detached from the supporting bar 110, specifically the fixing part 111-1, by preventing torsional stress caused by a drawing motion of the drawer 20 being drawn out of and retracted into the main body 10 from being concentrated on the slide rail locking device 100.

Figure 5:
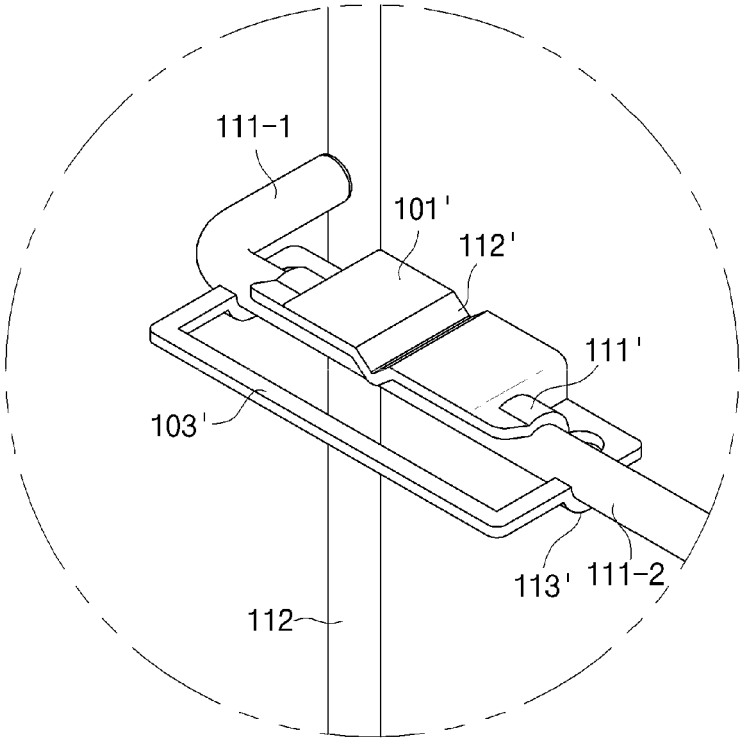
FIG. 5 is a perspective view of a slide rail locking device according to a second embodiment of the present invention.
Figure 6:
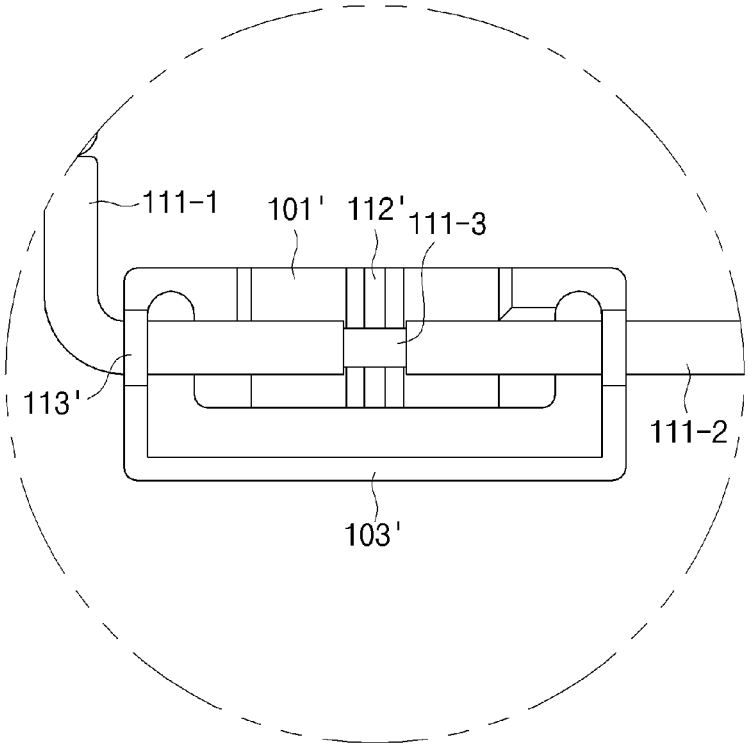
FIG. 6 is a bottom view of the slide rail locking device according to the second embodiment of the present invention.
Figure 7:
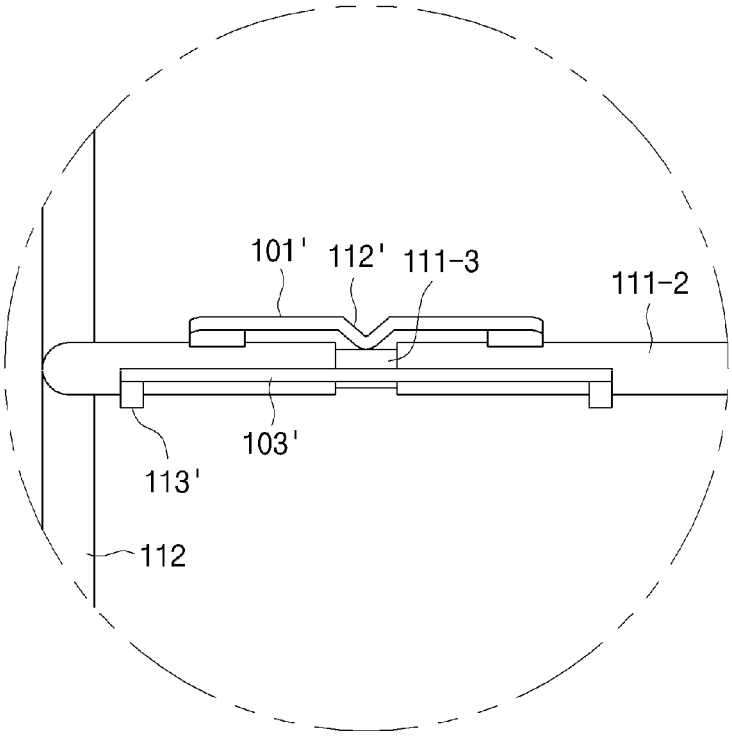
FIG. 7 is a side view of the slide rail locking device according to the second embodiment of the present invention.

FIG. 5 is a perspective view of a slide rail locking device according to a second embodiment of the present invention, FIG. 6 is a bottom view of the slide rail locking device according to the second embodiment of the present invention, and FIG. 7 is a side view of the slide rail locking device according to the second embodiment of the present invention.

Hereinafter, the second embodiment of the slide rail locking device 100 according to the present invention will be described in more detail with reference to FIGS. 5 to 7.

The slide rail locking device 100 includes a second upper locking plate 101' and a second lower locking plate 103'. The second upper locking plate 101' is located above the supporting bar 110 (in more detail, above the supporting part 111-2), and is locked into the slide rail 30. The second upper locking plate 101' is a part to which the slide rail 30 is mounted, and the slide rail 30 fixed to the side surface or bottom surface of the drawer 20 may be mounted to the upper surface of the second upper locking plate 101'.

In addition, the second lower locking plate 103' is formed by being extended from the opposite ends of the second upper locking plate 101', and is located below the supporting bar 110 (in more detail, below the supporting part 111-2). Provided the slide rail locking device 100 is mounted to the supporting bar 110, one side of the second lower locking plate 103' is brought into contact with the fixing part 111-1. Accordingly, a location of the slide rail locking device 100 is fixed on the supporting bar 110.

That is, the slide rail locking device 100 of the second embodiment is not provided with a separate connection plate 102 differently from the first embodiment, and is a structure wherein the second upper locking plate 101' and the second lower locking plate 103' are directly connected.

The second upper locking plate 101' includes an upper supporting part 111' and a bent part 112'. The upper supporting parts 111' is formed at opposite ends of the second upper locking plate 101', and may be a semicylindrical shape to be brought into contact with an upper part of the supporting part 111-2. In addition, the bent part 112' is provided in a direction perpendicular to the supporting part 111-2, and formed to be bent downwards. The bent part 112' plays a role to fix a location of the slide rail locking device 100 on the supporting part 111-2 by being seated in a step 111-3 which will be described later.

In addition, the second lower locking plate 103' includes supporting parts 113 of semicylindrical shape being in contact with a lower part of the supporting part 111-2, and the supporting part 111-2 includes the step 111-3 formed along circumference of the supporting part 111-2 and the bent part 112' is seated in.

Accordingly, when coupling the slide rail locking device 100 of the second embodiment to the supporting bar 110 (in more detail, the supporting part 111-2), the slide rail locking device 100 is forced to move from the inside of the main body 10 toward the supporting bar 110 installed on the inside wall of the main body 10. At this time, it is desirable to move the bent part 112' to be seated in the step 111-3.

Accordingly, when an external force is applied on the slide rail locking device 100 to bring the device into contact with the supporting part 111-2, and the second upper locking plate 101' and the second lower locking plate 103' brought contact with the supporting part 111-2 by external force are elastically deformed to be spread from each other.

Thereafter, the second upper locking plate 101' and the second lower locking plate 103' are recovered so that the upper supporting parts 111' are brought into contact with the upper surface of the supporting part 111-2 and the lower supporting parts 113' are brought into contact with the lower surface of the supporting part 111-2. Accordingly, the slide rail locking device 100 is mounted to the supporting bar 110 (in more detail, the supporting part 111-2).

At this time, the slide rail locking device 100 may be fixed to the supporting bar 110 (in more detail, the supporting part 111-2) at one or more places among contact places between supporting parts 111' and the supporting part 111-2, and contact places between the supporting parts 113' and the supporting part 111-2 by welding and so on When the slide rail locking device 100 as above is applied, the device has an advantage of being attached and detached more easily as described above while maintaining locking force comparing with a conventional slide rail locking device.

The embodiments of the present disclosure are intended to fully describe the present disclosure to a person having ordinary knowledge in the art (named as 'those skilled in the art,' hereinafter) to which the present disclosure pertains. Accordingly, the exemplary embodiments of the present invention are merely examples and should not be understood to limit the scope of the present invention as the present invention is not limited to foregoing embodiments and accompanying drawings. Accordingly, those skilled in the art may clearly understand that various substitutes, modifications, and changes are possible without departing from the technical spirit, and the parts which those skilled in the art can easily change belong to the protection scope of the present invention.

The invention claimed is:

1. A slide rail locking device coupling a supporting bar mounted on an inside wall of a main body to a slide rail fixed to a side surface or a bottom surface of a drawer, wherein the supporting bar includes:

a plurality of horizontal supporting bars; and a plurality of vertical supporting bars disposed perpendicular to the plurality of horizontal supporting bars, with opposite ends of the plurality of horizontal supporting bars being fixed thereto;

wherein the slide rail locking device comprises:

an upper locking plate located above one of the plurality of horizontal supporting bars, and locked to the slide rail;

a lower locking plate located below the one of the plurality of horizontal supporting bars;

a connection plate connecting the upper locking plate and the lower locking plate to each other; and an extended plate having a concaved upper surface and a protruded lower surface to face the upper locking plate; and wherein a gap is present between the slide rail locking device and the plurality of vertical supporting bars to make the slide rail locking device not contacted with the plurality of vertical supporting bars and to separate the slide rail locking device from one of the plurality of vertical supporting bars by a predetermined distance, wherein each of the plurality of horizontal supporting bars includes:

a plurality of fixing parts disposed in parallel with each other and extending toward an inside of the main body, with first ends thereof being mounted perpendicular to the vertical supporting bars; and a supporting part connecting second ends of the plurality of fixing parts to each other, wherein the upper locking plate, the lower locking plate, and the connection plate are disposed to surround one of the plurality of fixing parts, and the one of the plurality of fixing parts is fixed to at least one of the upper locking plate, the lower locking plate, and the connection plate; and one end side of the upper locking plate and one end side of the lower locking plate are connected to each other via the connection plate, and the other sides of the upper locking plate and the lower locking plate are not connected to each other; and wherein the slide rail locking device further comprises an inclined plate inclined upward toward an associated one of the supporting parts from a side portion of the extended plate, the inclined plate formed at one end of the lower locking plate opposite to where one of the fixing parts is positioned, the inclined plate being elastically deformable to be spread downwards when an external force is applied.

2. A slide rail locking device coupling a supporting bar mounted on an inside wall of a main body to a slide rail fixed to a side surface or a bottom surface of a drawer, wherein the slide rail locking device comprises:

an upper locking plate located above the supporting bar, and locked to the slide rail; and a lower locking plate formed by being extended from opposite ends of the upper locking plate, and located below the supporting bar, wherein the supporting bar includes:

a plurality of horizontal supporting bars; and a plurality of vertical supporting bars disposed perpendicular to the plurality of horizontal supporting bars, with opposite ends of the plurality of horizontal supporting bars being fixed thereto;

wherein the upper locking plate is coupled to one of the plurality of horizontal supporting bars, and the upper locking plate includes:

an upper locking plate body;

upper supporting parts having a semicylindrical shape, the upper supporting parts formed at each opposite end of the upper locking plate body, the upper supporting parts brought into contact with an upper part of the one of the plurality of horizontal supporting bars; and a bent part formed in the upper locking plate body between the upper supporting parts and provided in a direction perpendicular to the one of the plurality of horizontal supporting bars, and formed to be bent downwards to be in contact with the one of the plurality of horizontal supporting bars.

3. The slide rail locking device of claim 2, wherein the lower locking plate includes a lower supporting part in a semicylindrical shape formed at each of opposite ends of the lower locking plate, and brought into contact with a lower part of the one of the plurality of horizontal supporting bars.

4. The slide rail locking device of claim 2, wherein the one of the plurality of horizontal supporting bars includes a step formed along a circumference of the one of the plurality of horizontal supporting bars, with the bent part being seated in the step.

5. A slide rail locking device coupling a supporting bar mounted on an inside wall of a main body to a slide rail fixed to a side surface or a bottom surface of a drawer, wherein the supporting bar includes:

a plurality of horizontal supporting bars; and a plurality of vertical supporting bars disposed perpendicular to the plurality of horizontal supporting bars, with opposite ends of the plurality of horizontal supporting bars being fixed thereto;

wherein the slide rail locking device comprises:

an upper locking plate located above one of the plurality of horizontal supporting bars, and locked to the slide rail;

a lower locking plate located below the one of the plurality of horizontal supporting bars, the lower locking plate having an upper surface and a lower surface, a first side surface connected to a connection plate, a second side surface opposite to the first side, a third side surface facing the supporting part and a fourth side surface opposite to the third side, the lower locking plate comprising:

a concave portion of which a surface is curved downward and formed in a lengthwise direction from the second side surface toward the first side surface; and an inclined portion connected to a side of the concave portion and formed at a corner of the lower locking plate, the inclined portion inclined upward from the side of the concave portion toward an end of the inclined portion opposite to the side of the concave portion, the inclined portion being elastically deformable to be spread downwards when an external force is applied; and the connection plate connecting the upper locking plate and the lower locking plate to each other;

wherein a gap is present between the slide rail locking device and the plurality of vertical supporting bars to make the slide rail locking device not contacted with the plurality of vertical supporting bars and to separate the slide rail locking device from one of the plurality of vertical supporting bars by a predetermined distance, wherein each of the plurality of horizontal supporting bars includes:

a plurality of fixing parts disposed in parallel with each other and extending toward an inside of the main body, with first ends thereof being mounted perpendicular to the vertical supporting bars; and a supporting part connecting second ends of the plurality of fixing parts to each other, wherein the upper locking plate, the lower locking plate, and the connection plate are disposed to surround one of the plurality of fixing parts, and the one of the plurality of fixing parts is fixed to at least one of the upper locking plate, the lower locking plate, and the connection plate;

a first end side of the upper locking plate and a first end side of the lower locking plate are connected to each other via the connection plate, and the second end sides of the upper locking plate and the lower locking plate are not connected to each other; and the inclined portion has an end surface opposite to the side of the concave portion, and the end surface of the inclined portion is brought into contact with a lower part of an outer circumference of the supporting part when the slide rail locking device is mounted to the supporting bar.

* * * * *